US008196427B2

(12) United States Patent
Bae et al.

(10) Patent No.: US 8,196,427 B2
(45) Date of Patent: Jun. 12, 2012

(54) APPARATUS FOR STORING FOOD AND METHOD FOR MANUFACTURING THE SAME

(75) Inventors: Jun Ho Bae, Seoul (KR); Kyung Seok Kim, Seoul (KR); Chang Joon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 809 days.

(21) Appl. No.: 12/257,709

(22) Filed: Oct. 24, 2008

(65) Prior Publication Data

US 2009/0113924 A1 May 7, 2009

(30) Foreign Application Priority Data

Nov. 5, 2007 (KR) ..... 10-2007-0112338

(51) Int. Cl.
*F25D 17/04* (2006.01)
*F25D 17/06* (2006.01)

(52) U.S. Cl. ..... 62/408; 62/407; 62/411

(58) Field of Classification Search ..... 62/408, 62/407, 411
See application file for complete search history.

(56) References Cited

U.S. PATENT DOCUMENTS

| | | | | |
|---|---|---|---|---|
| 3,455,119 | A * | 7/1969 | Bright | 62/180 |
| 3,609,988 | A * | 10/1971 | Bright | 62/187 |
| 6,055,826 | A * | 5/2000 | Hiraoka et al. | 62/408 |
| 6,170,275 | B1 * | 1/2001 | Ueno et al. | 62/186 |
| 6,351,967 | B1 | 3/2002 | Adachi et al. | 62/441 |
| 2003/0077174 | A1 * | 4/2003 | Kim | 416/186 R |

FOREIGN PATENT DOCUMENTS

| | | | |
|---|---|---|---|
| KR | 10-2002-0057547 | A | 7/2002 |
| KR | 10-2007-0065575 | A | 6/2007 |

OTHER PUBLICATIONS

PCT International Search Report and Written Opinion dated Apr. 6, 2010 for Application No. PCT/KR2008/005417.

* cited by examiner

*Primary Examiner* — Frantz Jules
*Assistant Examiner* — Cassey D Bauer
(74) *Attorney, Agent, or Firm* — KED & Associates LLP

(57) ABSTRACT

An apparatus for storing food therein and method for manufacturing the same are disclosed. Space utilization efficiency can be enhanced by configuring a single-body duct diverging to different storage rooms. The present invention includes a first storage room and a second storage room to store food, and a duct unit includes a first duct to guide cold air into the first storage room, and a second duct to guide cold air into the second storage room. A scroll from which the first duct and the second duct diverge is located between the first and second ducts.

11 Claims, 20 Drawing Sheets

APPARATUS FOR STORING FOOD AND METHOD FOR MANUFACTURING THE SAME

This application claims the benefit of the Korean Patent Application No. 10-2007-0112338, filed on Nov. 5, 2008, which is hereby incorporated by reference as if fully set forth herein.

BACKGROUND

1. Field

The present disclosure relates to a food storage device and methods for manufacturing the same. Although the present invention is suitable for a wide scope of applications, it is particularly suitable for enhancing space utilization efficiency and for lowering manufacturing costs by reducing steps of a duct assembly process.

2. Background

A refrigerator/freezer is a globally-used food storage device. A refrigerator normally includes a freezing chamber and a cooling chamber. Typically, the cooling chamber is maintained at a temperature of approximately 3~4° C. to keep food and vegetables fresh for a considerably long time. The freezing compartment is maintained at a temperature below 0° C. to keep meat or food in a frozen state.

In a refrigerator, an evaporator together with a compressor, a condenser, and an expansion valve are used to generate cool air. The cold air is then blown into each storage room to keep an inner space of the storage rooms at specific temperatures. Ducts are provided to guide the cold air generated from the evaporator into the storage rooms.

However, an assembly process for configuring the ducts can get complicated. Also, the space for storing food within the storage rooms is decreased by the volume of the ducts.

BRIEF DESCRIPTION OF THE DRAWINGS

The embodiments will be described in detail with reference to the following drawings, in which like reference numerals refer to like elements, and wherein.

DETAILED DESCRIPTION

Reference will now be made in detail to preferred embodiments, examples of which are illustrated in the accompanying drawings. Wherever possible, the same reference numbers will be used throughout the drawings to refer to the same or like parts.

Figure 1:
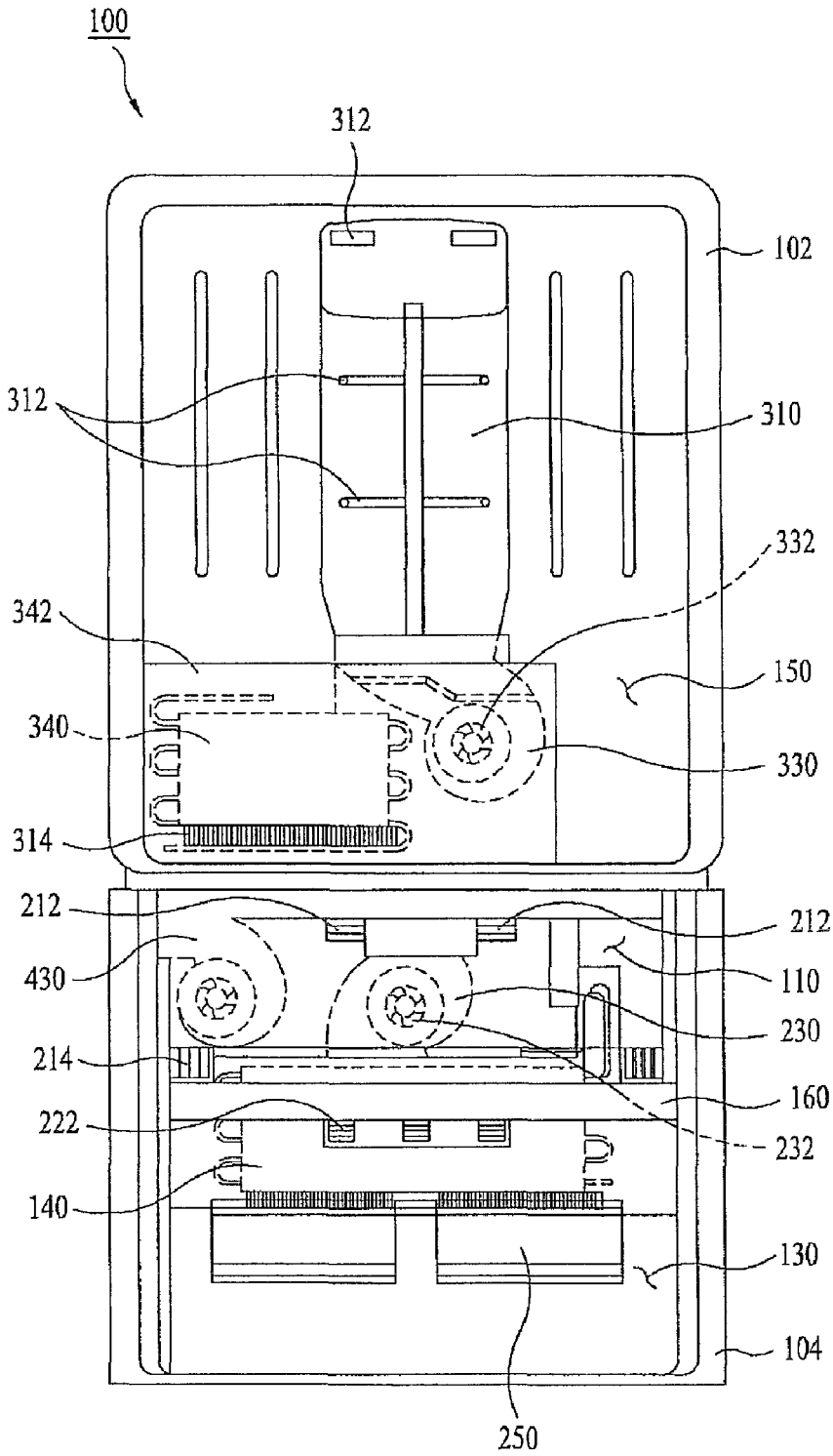
FIG. 1 is a front view of a first embodiment of a food storing apparatus.

FIG. 1 is a front diagram of a first embodiment of a food storing apparatus. Referring to FIG. 1, the apparatus 100 for storing food includes at least one storage room for storing food therein. Multiple storage rooms can be formed by partitioning an inner space of the apparatus 100. Generally, the food storing apparatus 100 includes a pair of storage rooms or three storage rooms. Of course, the food storing apparatus 100 can include more storage rooms.

The food storing apparatus can be categorized into a top mount type and a dual gate type in accordance with locations of the plurality of the storage rooms. For instance, the dual gate type food storing apparatus is configured to be partitioned into a left storage room and a right storage room. Doors for opening/closing each of the storage rooms are hinged to the lateral sides of the apparatus.

The top mount type food storing apparatus is configured to be partitioned into an upper storage room and a lower storage room. A door of the upper storage room is hinged to a lateral side of the apparatus. A door of the lower storage room typically has a drawer configuration to be pulled out or pushed in to open/close the corresponding storage room.

The food storing apparatus 100 shown in FIG. 1 has the top mount type configuration. However, alternate embodiments may have the dual gate type configuration, or still other different storage room configurations.

The food storing apparatus 100 according to the present invention includes a first storage room 110, a second storage room 130, and a third storage room 150, which are vertically partitioned from each other. Each of the storage rooms is preferably maintained at a specific temperature required for each storage state of food. For instance, if the second storage room 130 is used as a freezing compartment, it is maintained at a temperature below 0° C. to keep meat or food in a frozen state. If the third storage room 150 is used as a cooling chamber, it is maintained at a temperature range between 3~4° C. to keep food or vegetable in a fresh state.

Some embodiments, like the one shown in FIG. 1, can include a switching room, which is capable of varying its internal temperature. The switching room can be used as a freezing compartment or a cooling chamber in accordance with a request made by a user.

In this embodiment the second storage room 130 is used as a freezing compartment and the third storage room 150 is used as a cooling chamber. The first storage room 110 is used as a switching room and it can be configured to be maintained at a variable temperature in accordance with a user's request. Typically, a temperature of each of the freezing compartment and the cooling chamber can only be varied within a small range.

Referring to FIG. 1, the second storage room 130 is provided to a lower part of the food storing apparatus 100, while the third storage room 150 is provided to an upper part of the food storing apparatus 100. And, the first storage room 110 is provided between the second and third storage rooms 130 and 150. The food storing apparatus 100 can also include an upper frame 102 and a lower frame 104. In this case, the first and second storage rooms 110 and 130 are mounted on the lower frame 104, while the third storage room 150 is mounted on the upper frame 102. The lower frame 104 is partitioned into an upper part and a lower part to configure independent spaces for the first and second storage rooms 110 and 130, respectively.

As mentioned in the foregoing description, drawer type doors (not shown in the drawing) would typically be mounted on the first and second storage rooms 110 and 130. The drawers could then be pulled out or pushed in to open/close the corresponding rooms. A door of the third storage room 150 would usually be hinged to a lateral side of the upper frame 102.

A first cooler 140 for generating cold air and a first scroll part 230 having a first blowing fan 232 can be mounted on a backside wall of the first and second storage rooms 110 and 130. In this case, the first cooler 140 can include an evaporator. The blowing fan 232 would generate a flow of air that passes over the evaporator and that is then delivered into the first and second storage rooms.

First and second outlets 212 and 222 are formed to discharge the cold air generated from the first cooler 140 into the first and second storage rooms 110 and 130, respectively. A first inlet 214 and a second inlet (not shown in the drawing) can be provided to return the cold air to the first cooler 140.

A guide 250 which forms an intake passage for collecting the cold air from the second storage room 130 is provided between a mechanical room (not shown in the drawing) provided to the lower part of the lower frame 104 and the second storage room 130. In this case, an inlet for the cold air collected from the second storage room 130 is omitted in the drawing.

The mechanical room provides a space for accommodating a compressor (not shown in the drawing), a condenser (not shown in the drawing) and the like.

A cold air circulation mechanism of an apparatus for storing food according to the present invention will be explained in detail later.

Figure 2:
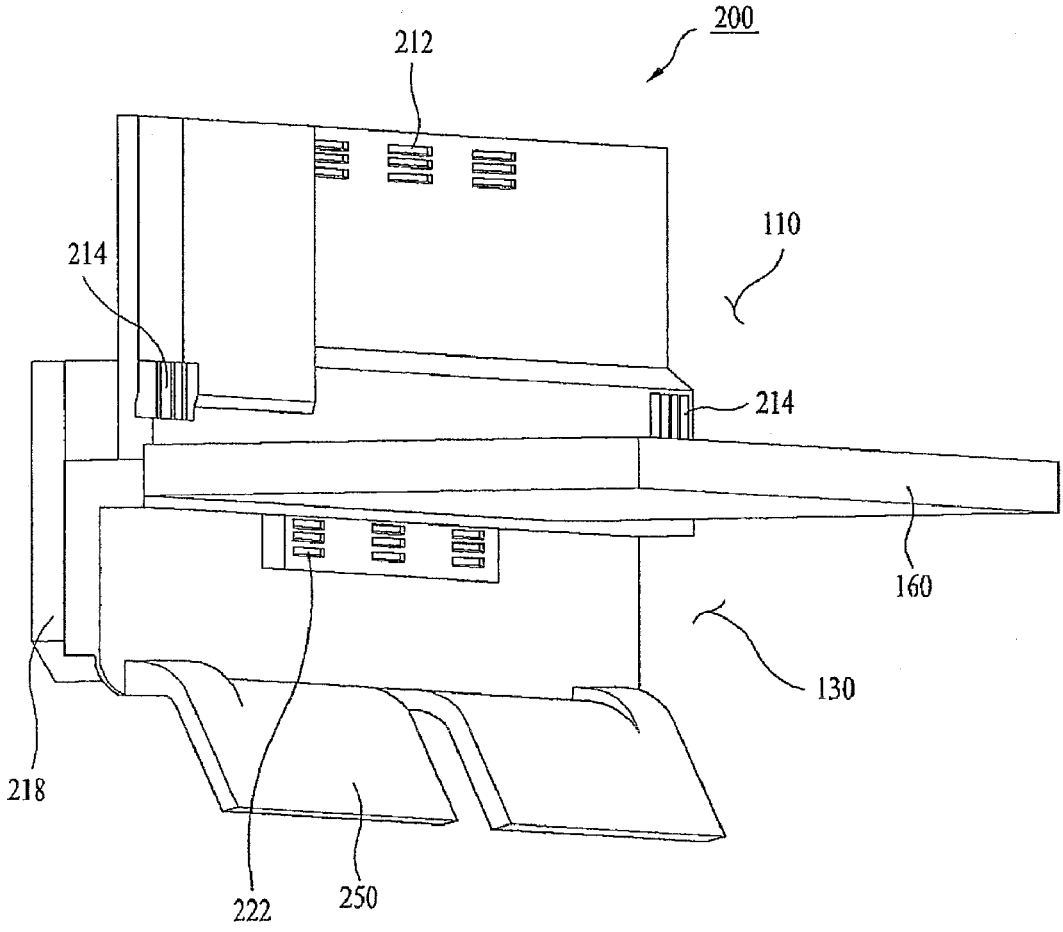
FIG. 2 is a perspective view of a duct unit of a food storing apparatus.
Figure 3A:
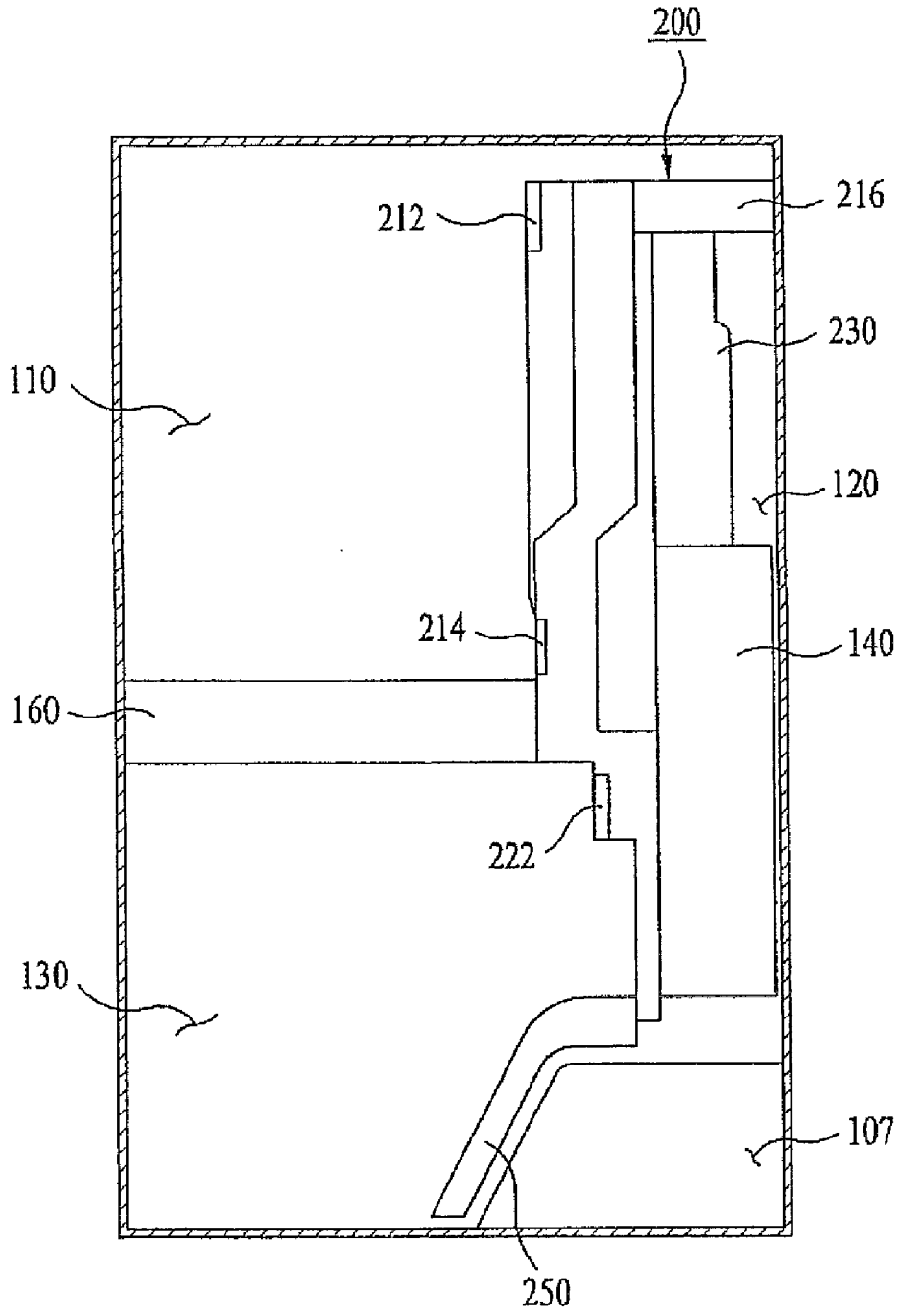
FIG. 3A is a side view of the food storing apparatus of FIG. 1 showing the duct unit of FIG. 2 installed therein.
Figure 3B:
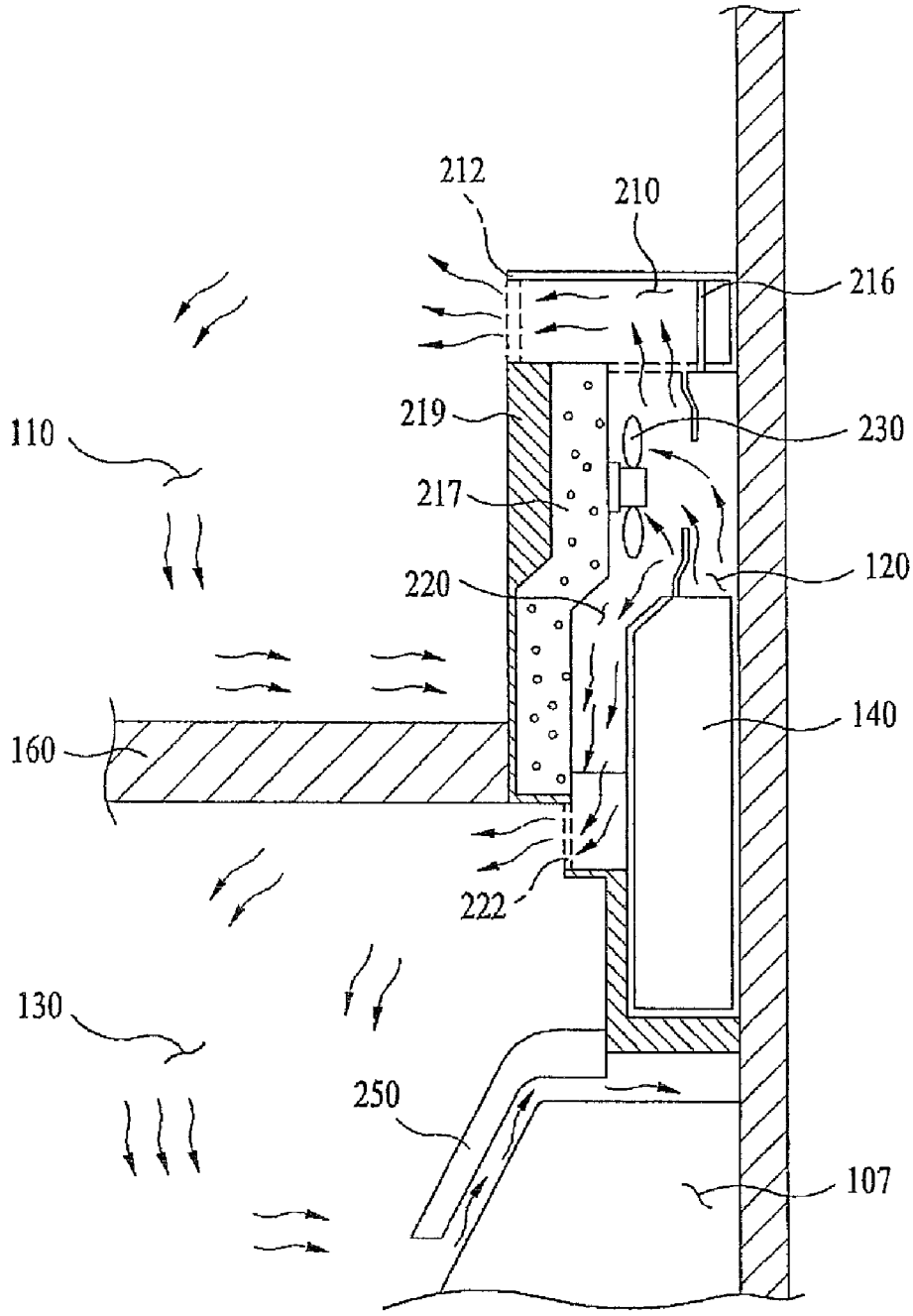
FIG. 3B is a cross-sectional diagram of the duct unit shown in FIG. 3A.
Figure 4A:
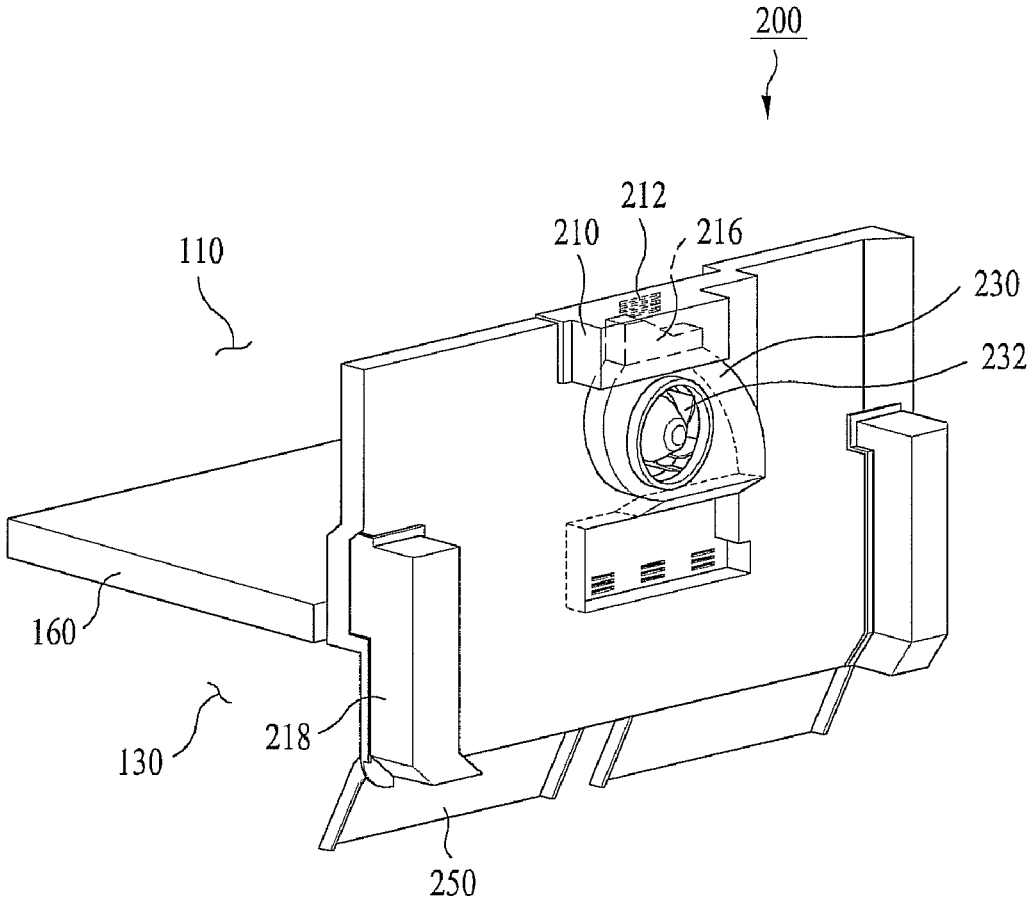
FIG. 4A is a rear perspective diagram of the duct unit.
Figure 4B:
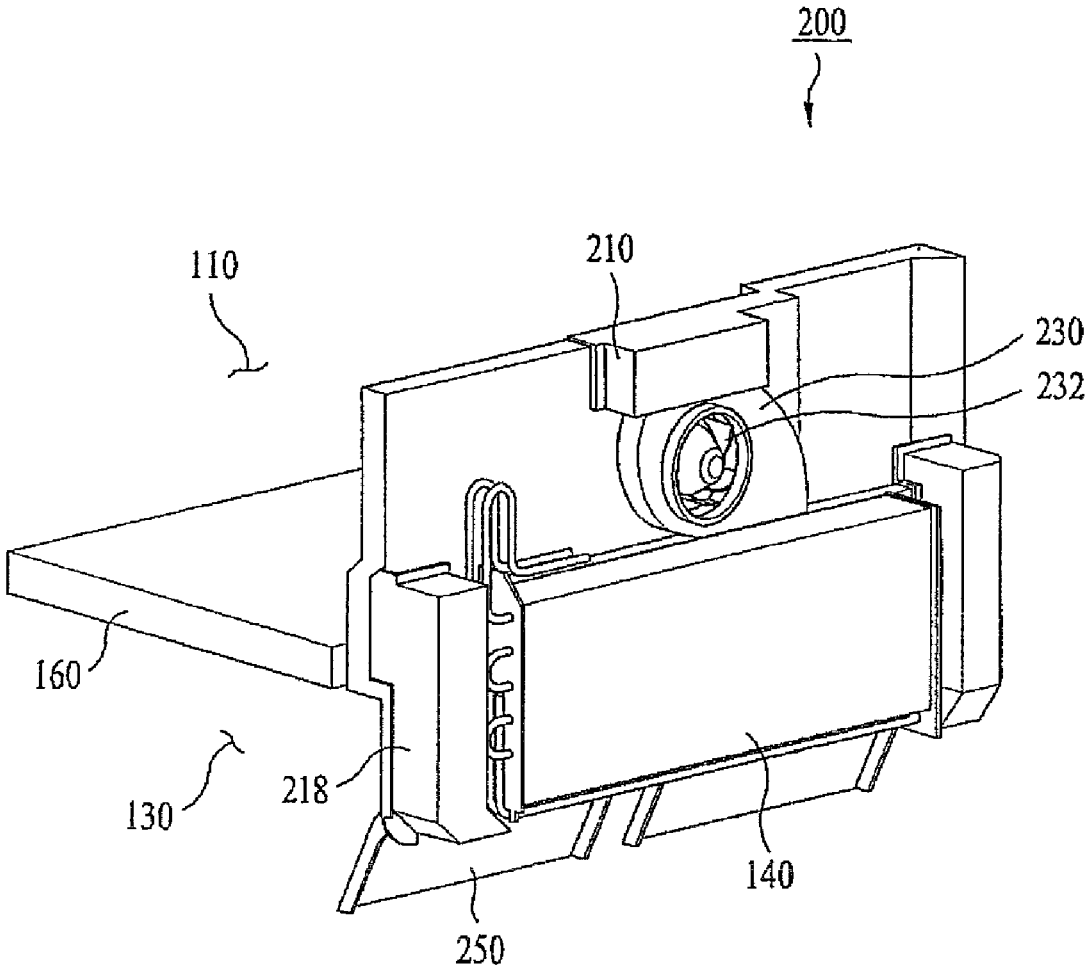
FIG. 4B is a perspective diagram of the duct unit after an evaporator has been installed.
Figure 4C:
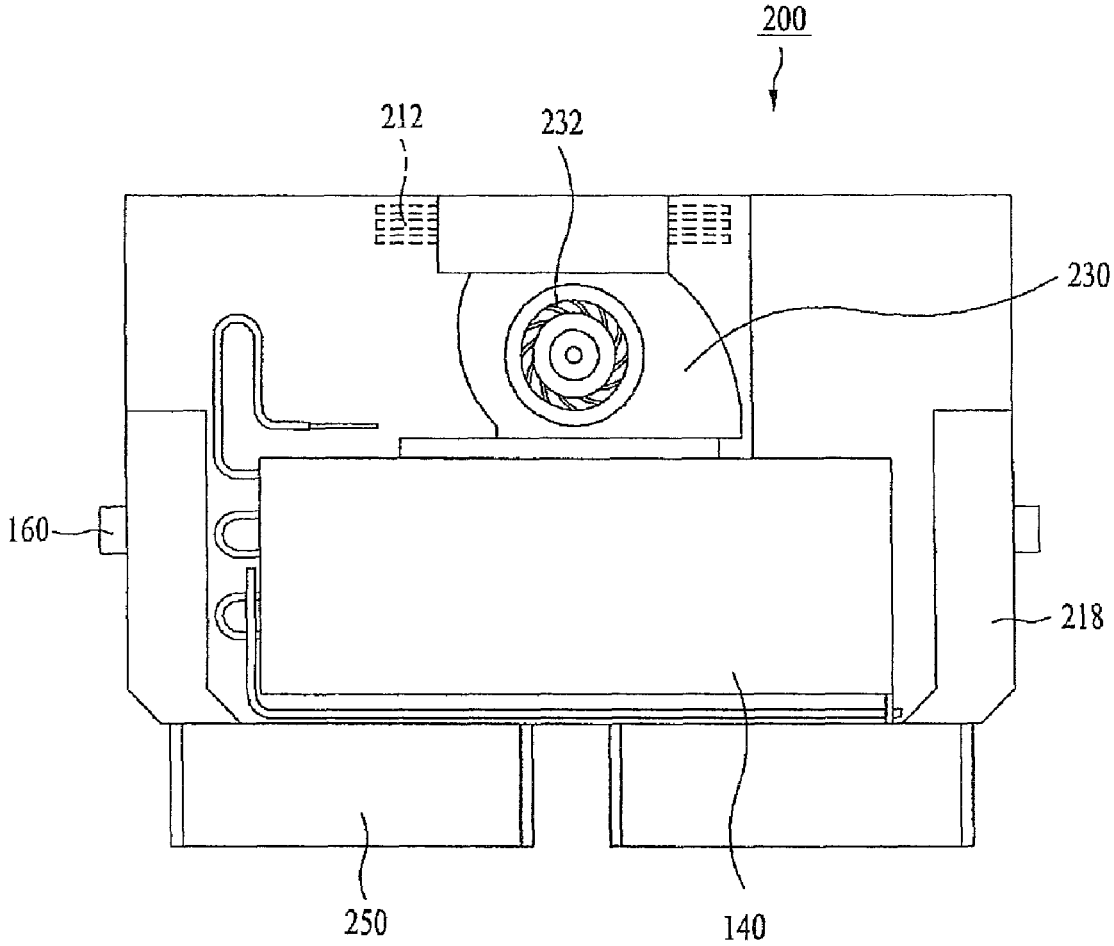
FIG. 4C is a rear diagram of the duct unit.
Figure 5:
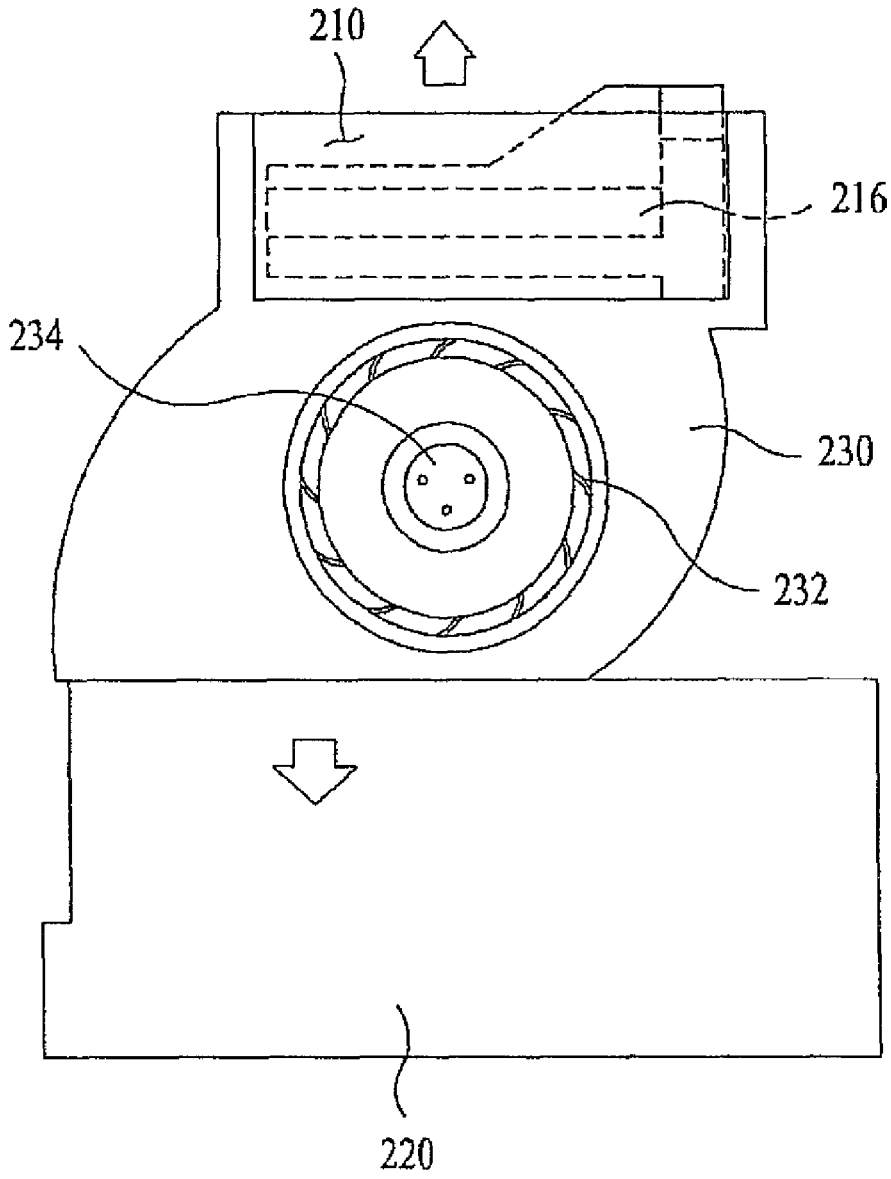
FIG. 5 is a rear diagram of a scroll part of the duct unit.

FIG. 2 is a perspective diagram of the duct unit of the lower portion of the food storing apparatus. FIG. 3A is a lateral diagram of the duct unit, and FIG. 3B is a cross-sectional diagram of the duct unit. FIG. 4A is a perspective diagram of the duct unit with the cooler removed, FIG. 4B is a perspective diagram of the duct unit with the cooler installed, and FIG. 4C is a rear diagram of the duct unit. FIG. 5 is a rear diagram of a scroll part of the duct unit.

The duct unit 200 includes a first duct part 210 guiding cold air to the first storage room 110, a second duct part 220 guiding cold air to the second storage room 130, and a scroll part 230 from which the first and second duct parts diverge from each other. In preferred embodiments, the first duct part 210, the second doctor part 220 and the scroll part are constructed as one body.

Since the first and second storage rooms 110 and 130 are provided to the lower frame 104, a partition 160 is included to partition the first and second storage rooms 110 and 130 from each other. The partition 160 is provided in parallel with a middle part of the lower frame 104 to enable the first and second storage rooms 110 and 130 to be vertically partitioned from each other within the lower frame 104. Optionally, the partition 160 is configured to be adjustable vertically to extend either the first storage room 110 or the second storage room 130 in accordance with a usage or purpose of the first or second storage room 110 or 130.

Preferably, the partition 160 is made of an insulating material. For instance, an inner portion of the partition 160 is formed porous to interrupt heat transfer using air insulation in the pores. The partition 160 is configured to have a thickness suitable for insulation efficiency. Since the partition 160 is made of the insulating material, heat exchange is prevented from taking place between the first and second storage rooms 110 and 130. Hence, each of the first and second storage rooms 110 and 130 can be maintained at different temperature ranges in accordance with food stored therein. Typically, one of the first and second storage rooms 110 and 130 would be maintained at a constant internal temperature and the other is used as a switching room whose internal temperature is variable in accordance with a user request.

In other words, one of the first and second storage rooms 110 and 130 would be either a freezing compartment or a cooling chamber, which is maintained at a constant temperature. The other is used as a switching room which can be selectively configured as a freezing compartment or a cooling chamber.

The switching room can also be maintained at a prescribed temperature which is lower than a cooling storage temperature but higher than a freezing temperature. This can help to keep vegetables or fruits fresh for a long term. And, the switching room is usable to store 'Kimchi' and the like therein. Owing to the advantage in coping with a user request actively, the switching room is now widely used.

Optionally, both of the first and second storage rooms 110 and 130 are usable as switching rooms. In particular, both of the first and second storage rooms 110 and 130 can be configured to be maintained at a specific temperature range and can be also used as freezing compartments or cooling chambers identically.

For instance, the first storage room 110 could be used as a freezing compartment and the second storage room 130 could be used as a cooling chamber. Alternatively, both of the first and second storage rooms 110 and 130 can be identically used as freezing compartments or cooling chambers.

In the present embodiment, the first storage room 110 is used as a switching room and the second storage room 130 is used as a freezing compartment. In order to vary or maintain a temperature of the switching room efficiently, it is preferable that the second storage room 130 is used as the freezing compartment. It is efficient to adjust a temperature of a switching room using a damper provided to a duct. This makes it possible for both rooms to share a single cooler for supplying cold air. Of course, as mentioned in the foregoing description, since both of the first and second storage rooms 110 and 130 are usable as switching rooms, the second storage room 130 is not limited to only being a freezing chamber.

The duct unit 200 includes a first duct part 210 guiding cold air to the first storage room 110, a second duct part 220 guiding cold air to the second storage room 130, and a scroll part 230 from which the first and second duct parts 220 diverge from each other. In the following description, the scroll part 230 will be referred to as the first scroll part 230.

The duct unit 200 may further include a blowing fan 232 provided to the first scroll part 230 to generate a flow of cold air. In the following description, the blowing fan 232 will be referred to as the first blowing fan 232.

Preferably, the first blowing fan 232 has a box fan type configuration. The box fan has its motor mounted inside a scroll-type fan blade unit. This allows the box fan to be very thin. The first blowing fan 232, as shown in FIG. 3B, is configured to blow cold air in a radial direction by sucking the cold air in an axial direction. The first scroll part 230 has a streamlined shape to efficiently guide the flow of cold air. The cooler used in this duct unit will be referred to as the first cooler 140 in the following description.

The first blowing fan 232 is provided to a central part of the internal space of the first scroll part 230. And, an opening is provided to the first scroll part 230 to suck cold air in an axial direction of the first blowing fan 232. Thus, cold air which passes through the first cooler 140, is sucked by a sucking force of the first blowing fan 232 in an axial direction of the first blowing fan 232 and is then blown in a radial direction off the first blowing fan 232.

The first duct part 210 is connected to one side of the first scroll part 230 in the radial direction of the first blowing fan 232, and the second duct part 220 is connected to the other side of the first scroll part 230 in the radial direction of the first blowing fan 232. The first duct part 210 communicating with one side of the first scroll part 230 guides the cold air blown in the radial direction of the first blowing fan 232 to the first storage room 110, while the second duct part 220 communicating with the other side of the first scroll part 230 guides the cold air blown in the radial direction of the first blowing fan 232 to the second storage room 130.

A direction for connecting the first scroll part 230 to each of the first and second duct parts 210 and 220 can be decided in accordance with positions of the first and second storage rooms 110 and 130. In the present embodiment, since the first storage room 110 is placed over the second storage room 130, the first duct part 210 is connected to an upper side of the first scroll part 230 and the second duct part 220 is connected to a lower side of the first scroll part 230.

When the first and second duct parts 210 and 220 directly diverge from the first scroll part 230, lengths of the first and second duct parts 210 and 220 are decreased. This, in turn, reduces a space occupied by the ducting, which prevents a reduction in the inner volume of the storage rooms. As a result, a space for storing food, i.e., a space usable by a user is increased.

The first duct part 210, the second duct part 220 and the first scroll part 230 of the duct unit 200 can be built in one body. Alternatively, the duct unit 200 can be completed by assembling various members that are separately manufactured.

Preferably, the duct unit 200 further includes a first damper 216 for adjusting a flow of the cold air through the first duct part 210. As mentioned in the foregoing description, when the first and second storage rooms 110 and 130 are configured to be a switching room and a constant temperature room, respectively, the amount of cold air guided to the first storage room 110 can be adjusted by the first damper 216 to enable temperature variations of the first storage room 110. The first damper 216 is configured to turn on/off a passage of the cold air guided to the first storage room 110 by the first duct part 210 or to adjust a quantity of the cold air supplied to the first storage room 110 by lowering or raising an opening ratio of the passage. It is preferable that the first damper 216 is built on the first duct part 210 in one body of the duct unit 200.

In alternate embodiments, a damper or flow control mechanism could be installed on just the second duct part 220 to selectively control the temperature of the second storage room 130. In still other embodiments, a damper or flow control mechanism could be provided in both the first duct portion 210 and the second duct portion 220 so that the temperatures in both the first and second storage rooms can be selectively and independently controlled. This would also allow cool air to be temporarily diverted to one of the rooms to quickly cool food items that have just been introduced to one of the storage rooms.

The food storing apparatus 100 can further include a light source (not shown in the drawing) and/or a heater (not shown in the drawing) to quickly raise a temperature of the first storage room 110 after it has been kept at a low temperature. For instance, the light and/or heater could be used to warm the switching room up to above freezing after the room has been used as a freezing chamber.

The duct unit 200 can further include at least one first outlet 212 opening into the first storage room 110. The first outlet 212 can be formed on a case 219 of the duct unit 200 to discharge the cold air guided by the first duct part 210 into the first storage room 110. And, it is a matter of course that the at least one first outlet 212 should communicate with the first duct part 210.

Because the first duct part 210 is connected to an upper side of the first scroll part 230, to guide the cold air to an upper part of the duct unit 200, the at least one first outlet 212 is preferably provided to the upper side of the case 219. Since it is advantageous that the cold air is discharged from an upper side of the first storage room 110 to perform cold air circulation efficiently, a position of the at least one first outlet 212 is preferably provided at an upper part of the first storage room 110. One or more first outlets 212 can be provided, as suitable for a volume of the first storage room 110.

In the present embodiment, three first outlets 212, as shown in FIG. 2, are arranged in the middle of an upper part of the case 219. In this embodiment, the first outlets 212 are in parallel with each other. However, in alternate embodiments, other numbers and arrangements of the first outlets could be used. Also the first outlets can be positioned at different locations.

One or more inlets 214 can be provided to the lower side of the first storage room 110. The inlets 214 may also be formed on the case 219. The inlets 214 will suck the cold air out of the first storage room 110.

Because it is advantageous that the cold air is sucked from the lower part of the first storage room 110, to perform cold air circulation efficiently, the at least one inlet 214 is preferably located in a lower part of the first storage room 110. Any number of inlets 214 can be provided, as suitable for the volume of the first storage room 110. In the present embodiment, two first inlets 214, as shown in FIG. 2, are provided to both lower sides of the case 219. However, in other embodiments, other numbers and locations of the first inlets 214 could be used.

In addition, one or more return ducts 218 can be provided to guide the cold air sucked via the first inlets 214 to the first cooler 140. The return ducts 218 communicate with the first inlets 214 and preferably guide the cold air sucked via the first inlets 214 to a lower part of the first cooler 140. In the present embodiment, a pair of the return ducts 218, as shown in FIG. 4A or FIG. 4B, are provided to both sides of a rear part of the case 219, respectively. In particular, a pair of the return ducts 218 are connected to the first inlets 214 provided to both of the lower sides of the case 219 to guide the cold air to the lower part of the first cooler 140, respectively.

At least one or more second outlets 222 can be provided to one side of the second storage room 130 of the case 219 to discharge the cold air guided by the second duct part 220 into the second storage room 130. Because the second duct part 220 is connected to the lower side of the first scroll part 230 to guide the cold air to the lower part of the duct unit 200, it is preferable that the at least one second outlet 222 is provided to the lower side of the case 219.

Since it is advantageous that the cold air is discharged from an upper side of the second storage room 130, to perform cold air circulation efficiently, the at least one second outlet 222 is preferably provided to an upper part of the second storage room 130. The at least one outlet 222 is preferably provided to an upper part of the second storage room 130 in the vicinity of the partition 160. One or more second outlets 222 can be provided, as suitable for a volume of the second storage room 130.

The cold air discharged from the second outlet 222 lowers the temperature within the second storage room 130 and is then sucked back into the lower part of the first cooler 140 via a passage between the guide 250 and a mechanical room 107.

Meanwhile, the food storing apparatus 100 according to the present invention can include a constructing space part 120 provided to a wall stretching over the first and second storage rooms 110 and 130, and centering on the partition 160. The constructing space part 120 would accommodate the first cooler 140 therein. The constructing space part 120 can include a predetermined space configured to accommodate the first cooler 140 therein such that the frame is recessed from the rear wall. Alternatively, the constructing space part 120 can include a predetermined space occupied by the first cooler 140 such that the first cooler 140 is supported by a prescribed support body to adhere closely to the rear wall while the rear wall stays flat.

In any case, the duct unit 200 is assembled to block a front side of the constructing space part 120. As the duct unit 200 blocks the constructing space part 120 for accommodating the first cooler 140 therein, the constructing space part 120 does not have any cold air passage communicating with the first or second storage room 110 or 130 except the aforesaid cold air flow passages. And, an insulating member 217 is provided within the case 219 of the duct unit 200 to cut off heat exchange between the constructing space part 120 and each of the storage rooms 110 and 130, particularly the first storage room 110.

Thus, the duct unit 200 is manufactured in a manner that the first duct part 210, the second duct part 220, the first scroll part 230 and the damper are constructed in one body. The duct unit 200 is attached to or actually forms part of the rear wall side of the first and second storage rooms. The duct unit 200 also forms the front side of the constructing space part 120 for accommodating the first cooler 140 therein. As a result, a process for manufacturing the food storing apparatus 100 can be simplified.

In the present embodiments, the cooler is accommodated in the constructing space part 120 and it can extend over portions of at least two storage rooms. The duct unit 200 is installed to block the front side of the constructing space part 120, and the partition 160 for partitioning the frame into the respective storage rooms is then installed. Hence, the assembly process can be accomplished in a simple manner. As a result, assembly productivity can be enhanced.

Figure 6:
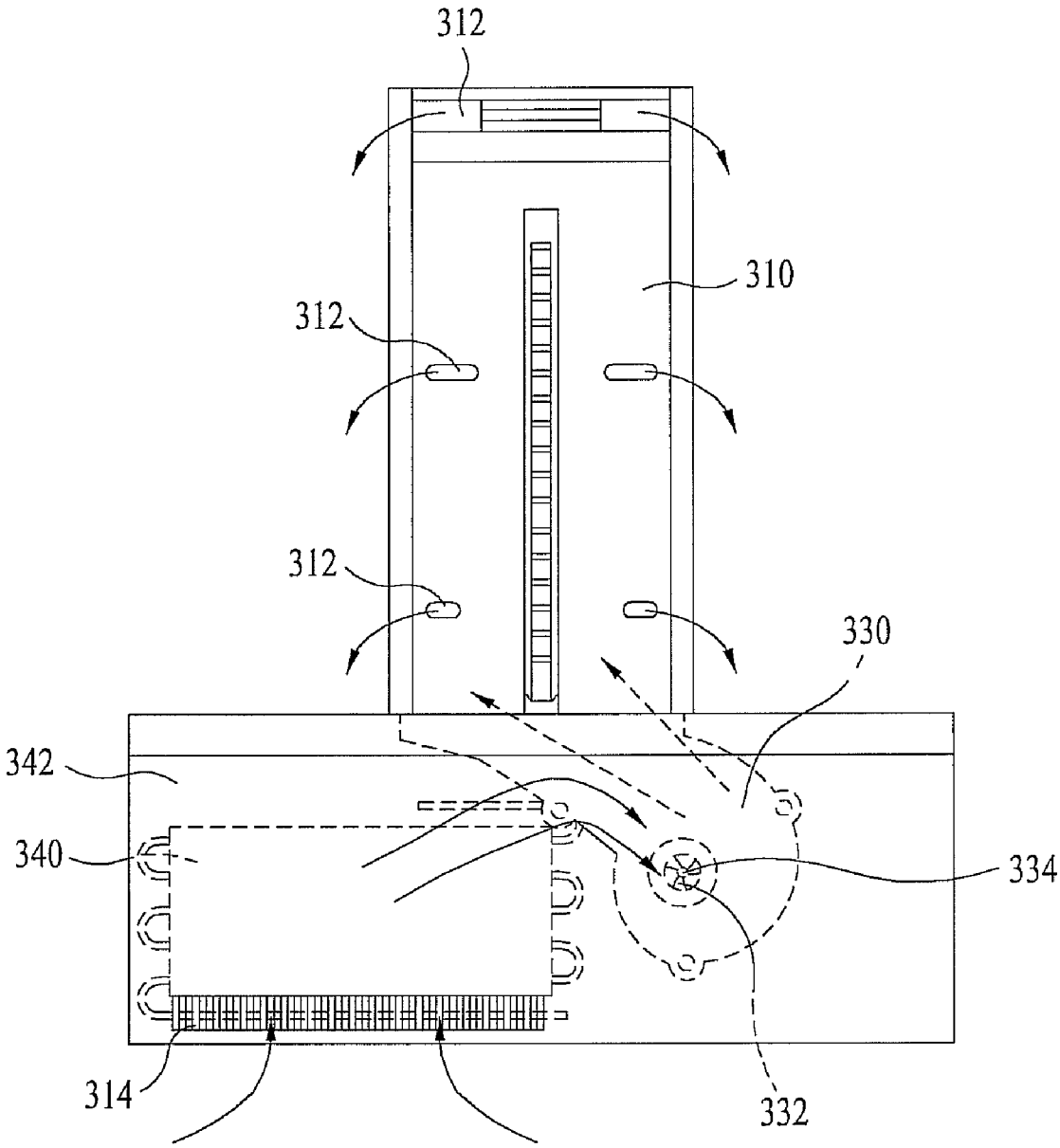
FIG. 6 is a front diagram of the upper portion of the food storing apparatus shown in FIG. 1.
Figure 7:
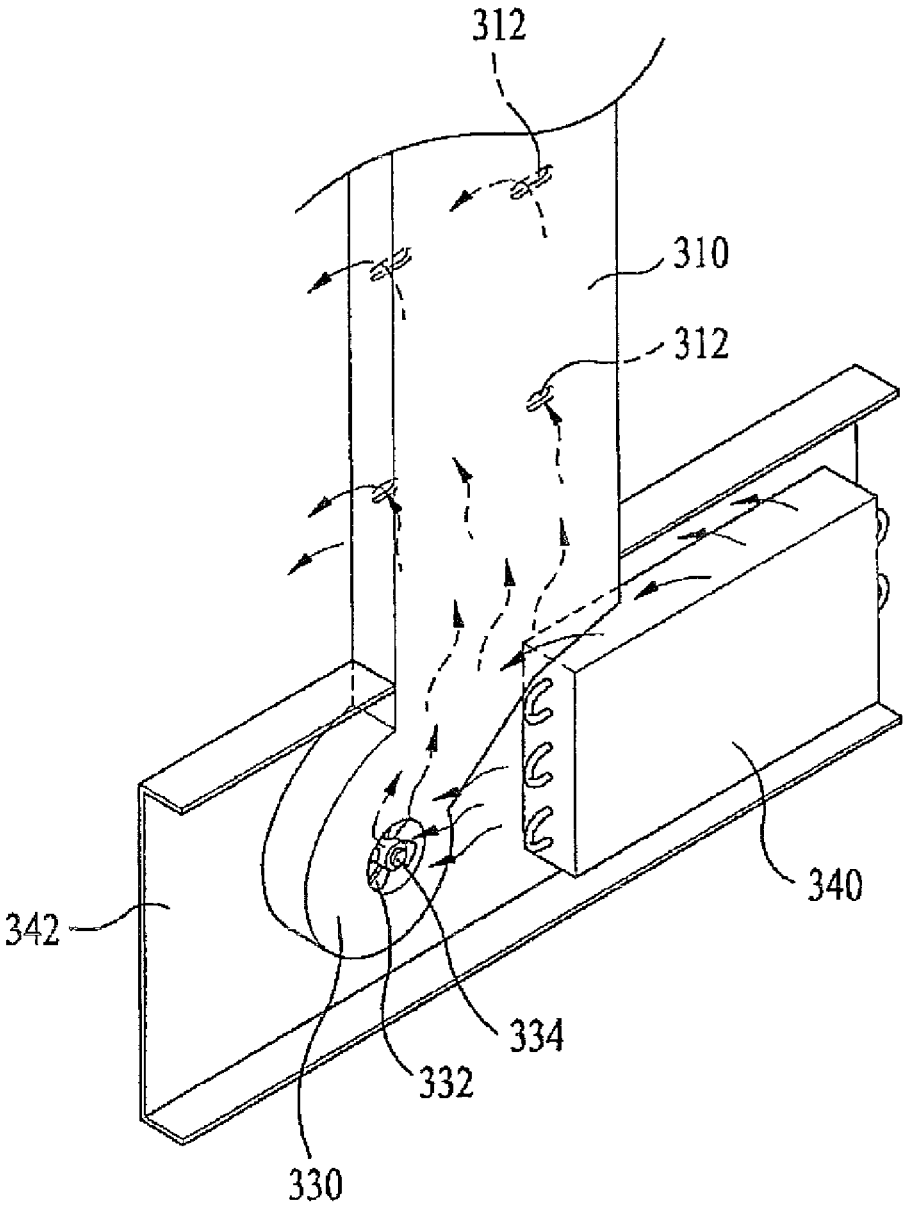
FIG. 7 is a rear perspective diagram showing the upper cooling chamber and a scroll part of a duct and fan of the food storing apparatus shown in FIG. 1.
Figure 8:
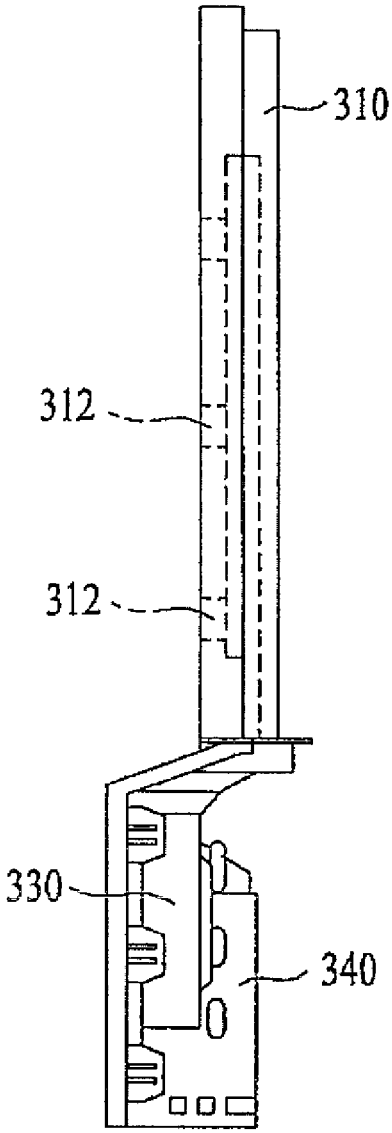
FIG. 8 is a side view of the cooler and scroll part shown in FIGS. 6 and 7.
Figure 9A:
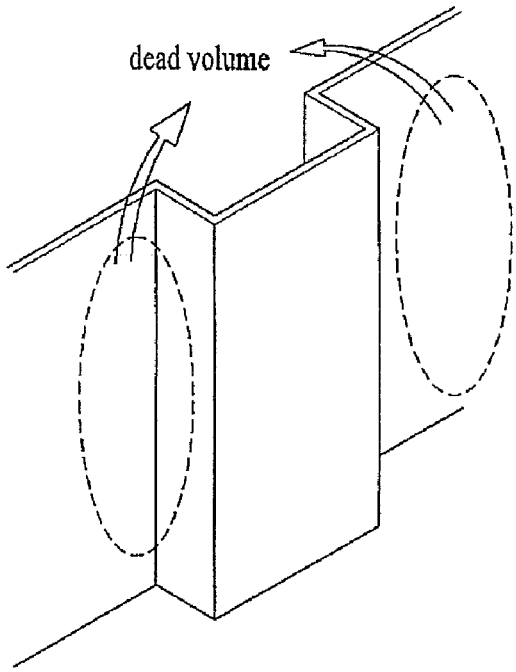
FIG. 9A is a perspective diagram to explain a dead volume when a scroll part is located above or below the cooler.
Figure 9B:
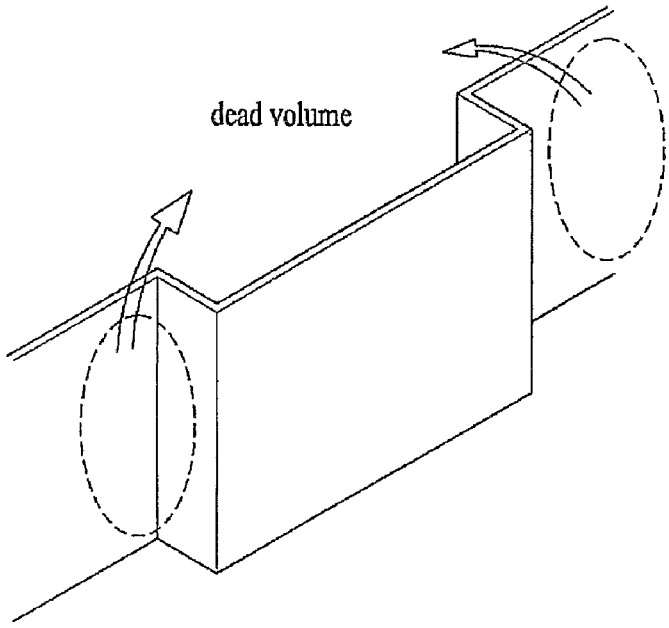
FIG. 9B is a perspective diagram to explain a dead volume when a scroll part is placed at one side of a cooler.

Arrangements of a cooler and a scroll part provided for the third storage room of the food storing apparatus will now be explained in detail with reference to the accompanying drawings. FIG. 6 is a front diagram showing a cooler, a scroll part and a duct for the third storage room of the food storing apparatus. FIG. 7 is a rear perspective diagram of these parts. FIG. 8 is a side view of these parts. FIG. 9A is a perspective diagram to explain a dead volume when a scroll part is mounted above or below a cooler. FIG. 9B is a perspective diagram to explain a dead volume when the scroll part is mounted at one side of the cooler.

A second cooler 340 is provided to the third storage room 150 to generate cold air. The second cooler 340 is provided to a rear wall side of the upper frame 102 and can be separated from the third storage room 150 by a cover 342.

A second blowing fan 332 is mounted to one side of the second cooler 340 to blow the cold air generated from the second cooler 340 into the third storage room 150. The second blowing fan 332 is provided to a central portion of an inner space of the second scroll part 330. Preferably, the second blowing fan 332 is a box fan type, in which the motor is mounted inside the blade assembly, to thereby reduce a thickness of the fan.

Preferably, the second blowing fan 332, as shown in FIG. 7, is configured to enable the cold air to be sucked in an axial direction and to be blown in a radial direction. The second blowing fan 332 generates a flow cold air in conjunction with the second cooler 340. The cold air is sucked in the axial direction of the second blowing fan 332 by the sucking force of the second blowing fan 332 and is then blown in the radial direction.

The second scroll part 330 is provided at one side of the second cooler 340. In particular, the second scroll part 330 can be provided next to a left or right side of the second cooler 340. The second scroll part 330 has a streamlined configuration to efficiently guide cold air generated by the cooler. And, a space for enabling the cold air to flow is provided within the second scroll part 330.

The second scroll part 330 is connected to a third duct part 310 and is configured to cross over a rear wall of the upper frame 102 in a vertical direction. The cold air generated from the second cooler 340 is sucked into the second scroll part 330 by the second blowing fan 332, guided by the third duct part 310, and then discharged into the third storage room 150. In order to discharge the cold air into the third storage room 150, a third outlet 312 is provided. The cold air discharged from the third outlet 312 plays a role in lowering a temperature within the third storage room 150.

The third duct part 310 can be provided over or under the second cooler 340 and the second scroll part 330. In the present embodiment, the third duct part 310, as shown in FIG. 6, is placed over the second cooler 340 and the second scroll part 330. The cold air blown in the radial direction of the second blowing fan 332 from the second scroll part 330 is guided to the third storage room 150 by the third duct part 310.

The second cooler 340 and the second scroll part 330 are provided to a lower side of a rear wall of the upper frame 102 and are isolated from the third storage room 150 by a cover 342. Preferably, at least one second inlet 314 is provided on the cover 342 at the lower side of the second cooler 340.

The cold air discharged into the third storage room 150 via the at least one third outlet 312 lowers a temperature within the third storage room 150, is sucked into the at least one inlet 314, and is then guided to the lower side of the second cooler 340. The cold air having passed through the second cooler 340 passes through the third duct part 310, the third outlet 312 and back into the third storage room.

If the second scroll part 330 is mounted to one side of the second cooler 340, a dead volume formed by a space occupied by the second cooler 340 and the second scroll part 330 can be reduced as compared to conventional arrangements. In conventional arrangements, the second scroll part 330 is provided over the second cooler 340. As a result, both lateral spaces next to the second cooler 340, as shown in FIG. 9A, form a dead volume unusable for a user. Since a height of a cold-air supply system including the cooler, the scroll part and the duct part is increased, an inner volume of the storage room is reduced overall.

However, in the present embodiment, because the second scroll part 330 is located in a space beside the second cooler 340, a height of the dead volume provided next to both sides of the second cooler 340, as shown in FIG. 9B, is reduced.

For instance, when the second scroll part 330 is placed over the second cooler 340, a dead volume is generated up to ½ the total height of the third storage room 150. On the other hand, if the second scroll part 330 is located beside the second cooler 340, a dead volume is generated up to only about ⅓ of the total height of the third storage room. Hence, the dead volume is reduced.

In alternate embodiments, the second scroll part 330 can be provided above or below the second cooler 340, and the third duct part 310 can be mounted to a horizontal side of the second cooler 340. This arrangement would have the same overall effect of reducing the dead volume of the third storage room.

A mechanism for supplying cold air to an icemaker of the food storing apparatus will now be explained in detail as follows.

Figure 10A:
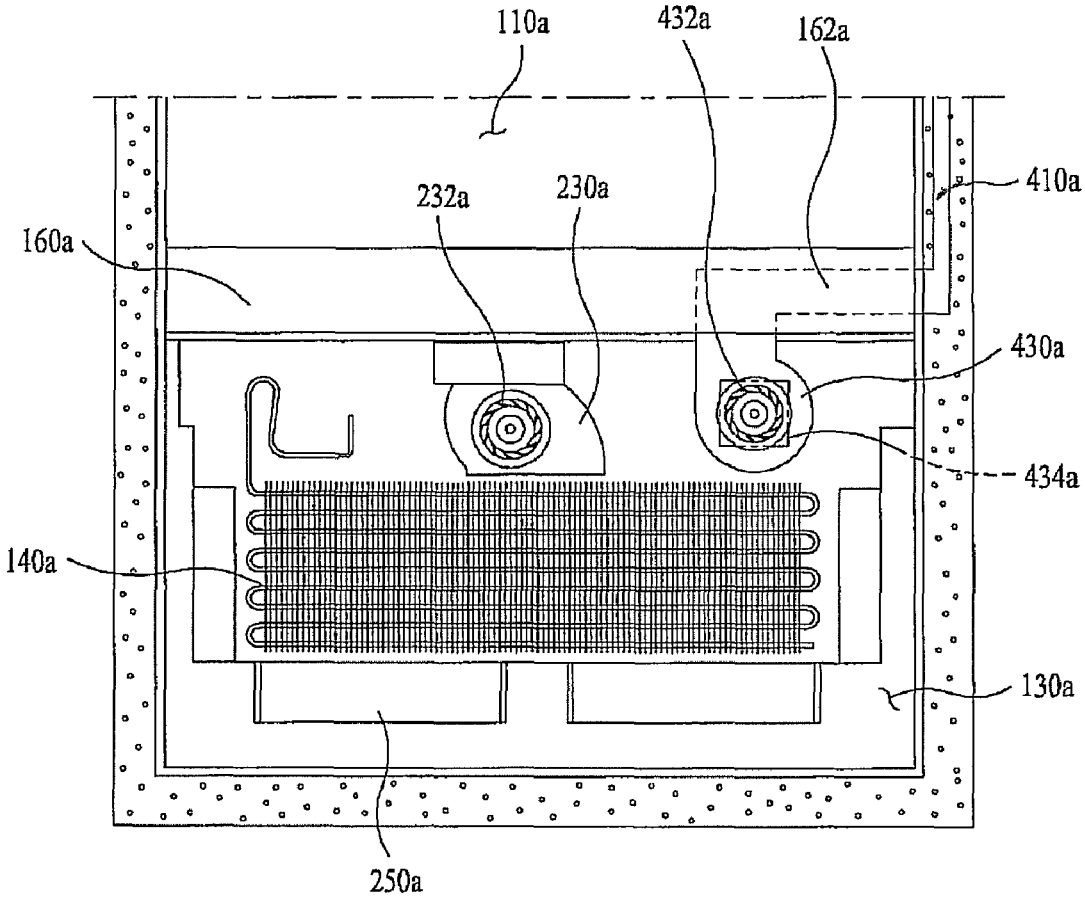
FIG. 10A is a schematic cross-sectional diagram of a portion of a cold-air supplying mechanism for an icemaker viewed from a backside of the food storing apparatus.
Figure 10B:
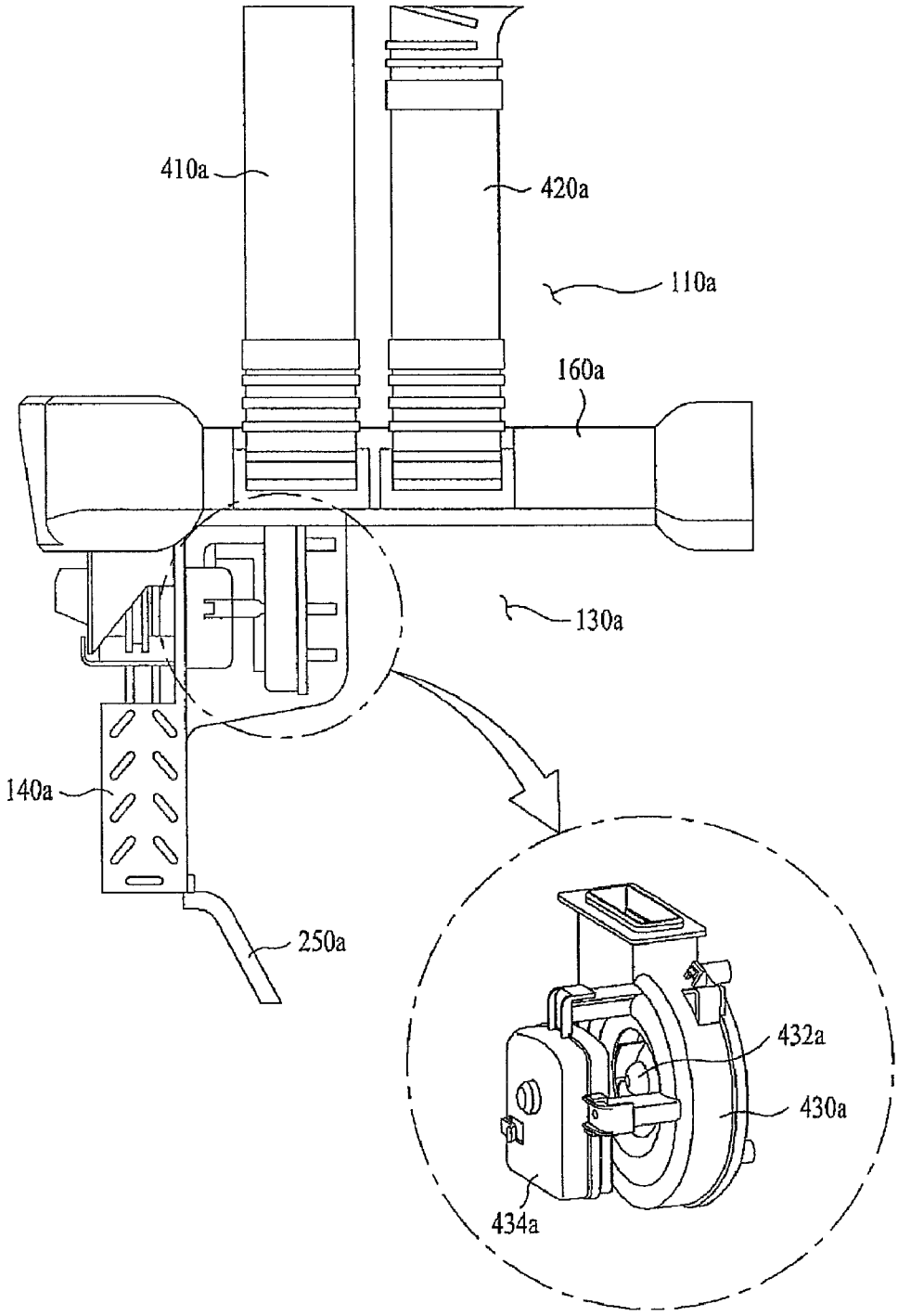
FIG. 10B is a side view of the icemaker cold-air supplying mechanism shown in FIG. 10A.
Figure 10C:
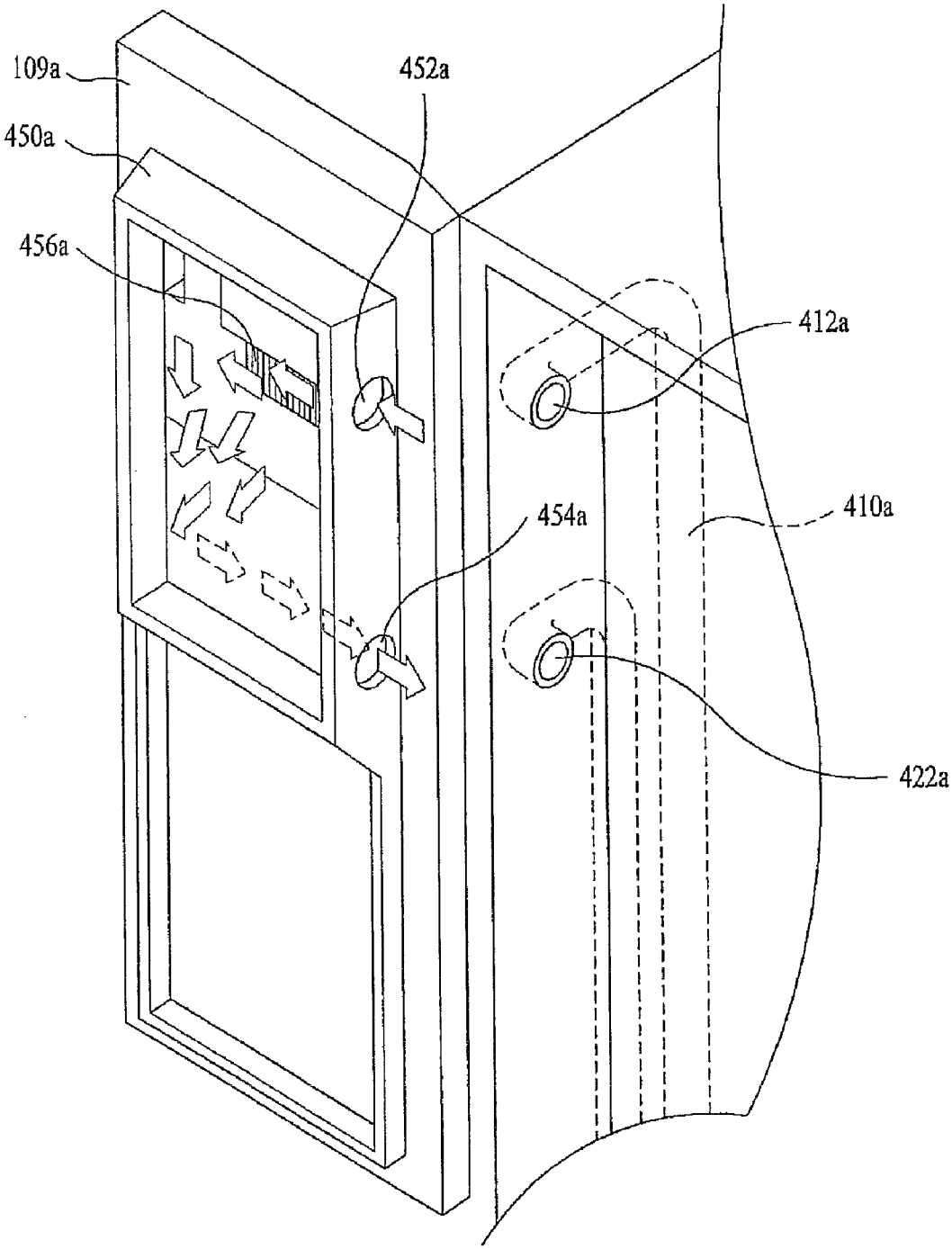
FIG. 10C is a perspective diagram illustrating the mechanism for supplying cold air to an icemaker provided in an upper part of a door.

FIG. 10A is a schematic cross-sectional diagram of an icemaker cold-air supplying mechanism viewed from a backside of the food storing apparatus. FIG. 10B is a side view of the icemaker cold-air supplying mechanism shown in FIG. 10A. FIG. 10C is a perspective diagram of a mechanism for supplying cold air to an icemaker provided in an upper door.

Referring to FIGS. 10A to 10C, a first cooler 140*a* is provided to a lower part of a rear wall of the food storing apparatus 100. A first blowing fan 232*a* blows cold air generated by the first cooler 140*a* into a first storage room 110*a* and a second storage room 130*a* as described above. The first blowing fan 232*a* is provided within a first scroll part 230*a*.

An ice-making fan unit 430*a* is provided next to one side of the first scroll part 230*a*. The ice-making fan unit 430*a* includes an ice-making fan 432*a* for blowing cold air and a motor 434*a* for providing a rotational force to the ice-making fan 432*a*.

The cold air blown by the ice-making fan 432*a* flows via a connecting duct 162*a* provided within the partition 160*a*. In this case, the connecting duct 162*a* is configured to communicate with a cold-air supplying duct 410*a* provided within a sidewall of the food storing apparatus 100. The cold air is guided to an icemaker 450*a* mounted in an upper door 109*a* via the cold-air supplying duct 410*a*. An inside of the sidewall is formed of an insulating material 106*a*, and the cold-air supplying duct 410*a* is formed within the insulating material 106*a*.

In particular, referring to FIG. 10C, the cold air guided by the cold-air supplying duct 410*a* is introduced into the icemaker 450*a* via a first cold air outlet 412*a* and a first cold air inlet 452*a*. The first cold air outlet 412*a* and the first cold air inlet 452*a* are configured to communicate with each other when the upper door 109*a* is closed. Packing is provided to each entrance of the outlet 412*a* and the inlet 452*a* to achieve air-tightness when the first cold air outlet 412*a* and the first cold air inlet 452*a* communicate with each other.

The cold air guided into the icemaker 450*a* freezes water accommodated in an ice-making tray 456*a* provided within the icemaker 450*a*. The cold air is then discharged outside the icemaker 450*a* via a second cold air outlet 454*a* and a second cold air inlet 422*a*. Like the first cold air outlet and inlet 412*a* and 452*a*, the second cold air outlet 454*a* and the second cold air inlet 422*a* are configured to communicate with each other when the upper door 109*a* is closed. Packing is provided to each entrance of the outlet 454*a* and the inlet 422*a* to achieve air-tightness when the second cold air outlet 454*a* and the second cold air inlet 422*a* communicate with each other.

The cold air discharged from the icemaker 450 returns to an inside of a storage room via a cold-air return duct 420*a* arranged in parallel with the cold air supplying duct 410*a*. Of course, the cold air return duct 420*a* is provided within the insulating material 106*a* of the sidewall as well.

In the above described embodiment, a portion of the ice-making fan unit 430*a*, as shown in FIG. 10B, projects forward toward the second storage room 130*a*. As a result, an inner volume of the storage room is reduced as much as the projected portion of the ice-making fan unit 430*a*. In addition, the connecting duct 162*a* provided within the partition 160*a* degrades the insulation performance of the partition 160*a*.

Figure 11A:
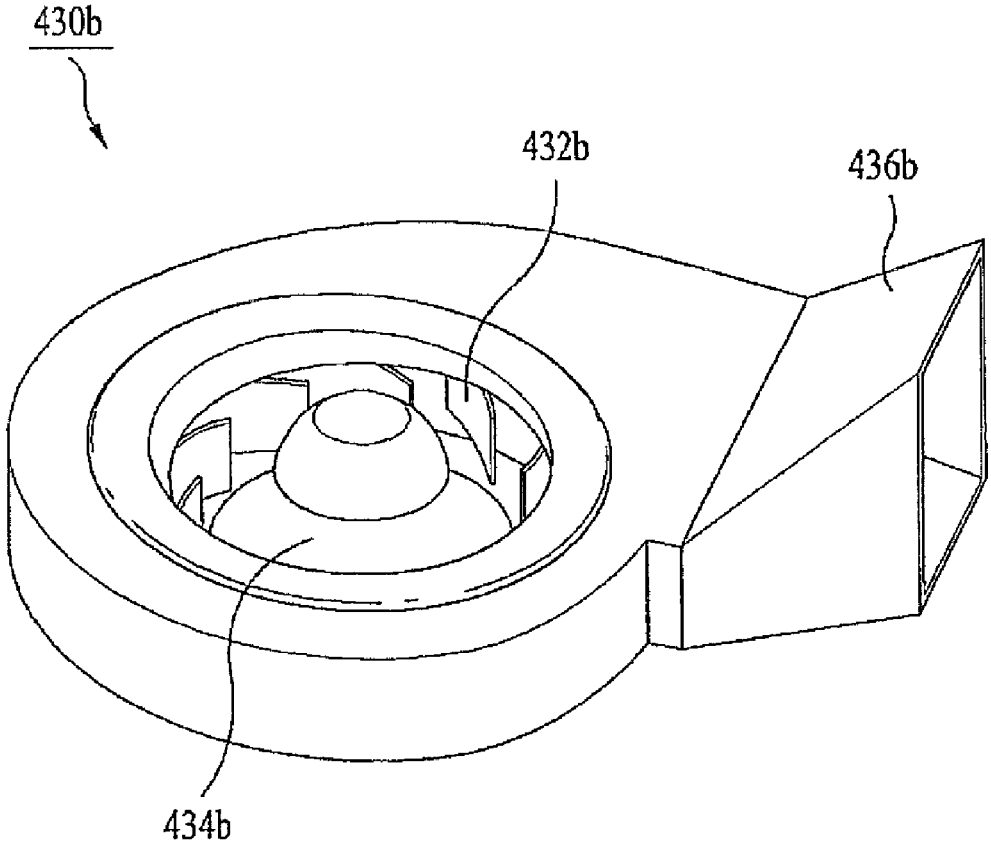
FIG. 11A is a perspective diagram of a fan unit of a food storing apparatus.
Figure 11B:
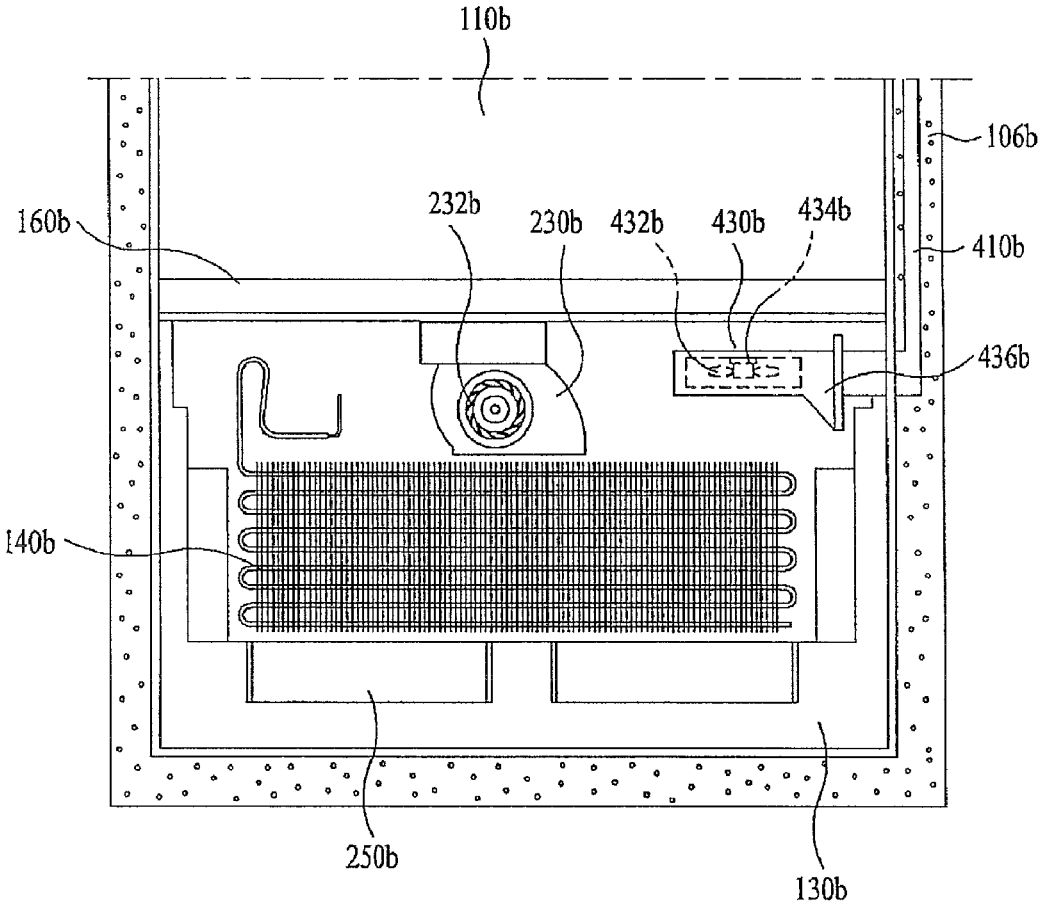
FIG. 11B is a schematic diagram of another embodiment of a cold-air supplying mechanism for an icemaker viewed from a backside of the food storing apparatus.
Figure 11C:
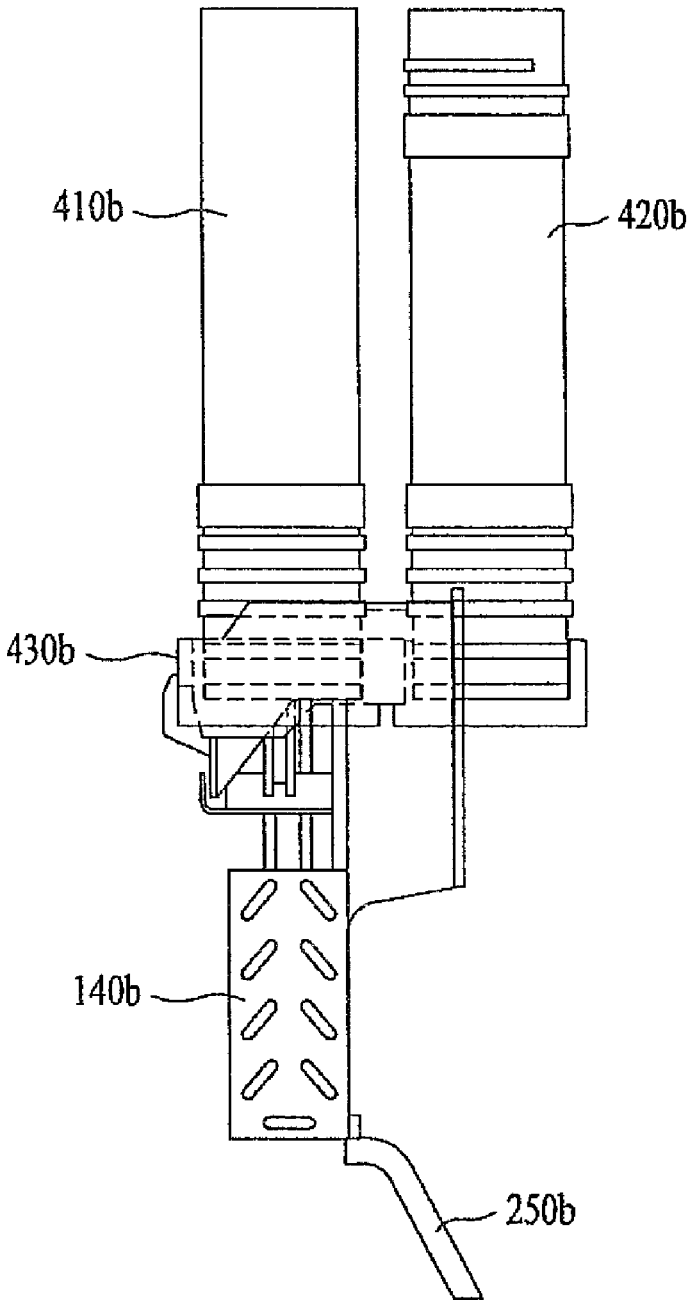
FIG. 11C is a side view of the icemaker cold-air supplying mechanism shown in FIG. 11B.

FIG. 11A is a perspective diagram of an ice-making fan unit of an alternate embodiment of a food storing apparatus. FIG. 11B is a schematic diagram of the icemaker cold-air supplying mechanism viewed from a backside of a food storing apparatus. FIG. 11C is a side view of the icemaker cold-air supplying mechanism.

Referring to FIGS. 11A to 11C, an apparatus 100 for storing food includes a cooler 140*b* for generating cold air, a cold air supplying duct 410*b* provided to one side of the apparatus 100 to guide at least one portion of the cold air generated from the cooler to an icemaker 450*a* (cf. FIG. 10C), and an ice-making fan unit 430*b* directly connected to the cold air supplying duct 410*b* to generate a flow of cold air.

Preferably, the ice-making fan 432 has a box fan type configuration having a fan and a motor 434*b* built in one body. The ice-making fan 432*b*, as shown in FIG. 11A, is preferably configured to suck the cold air in an axial direction and to blow the sucked cold air in a radial direction.

The ice-making fan unit 430*b* has a streamlined configuration to efficiently guide the cold air generated by the cooler. A space for enabling the cold air to flow therein is provided within the ice-making fan unit 430*b*. The motor 434*b* is mounted inside a fan blade unit of the ice-making fan unit 430*b*, and an opening is formed to suck the cold air in an axial direction of the ice-making fan 432*b*. A connecting part 436*b* is provided to one side of the fan, and it extends in the radial direction. The connecting part 436*b* guides the blown cold air to the cold air supplying duct 410*b*.

Preferably, the connecting part 436*b* is connected to the cold air supplying duct 410*b* at a sidewall of the food storing apparatus 100. In particular, the ice-making fan unit 430*b* is directly connected to the cold air supplying duct 410*b* at the sidewall via the connecting part 436*b*, instead of being connected to the cold air supplying duct 410*b* by a separate connecting duct 162*a* provided within the partition 160*b*, as in the embodiment shown in FIG. 10A and FIG. 10B. Because it is not necessary to have a separate connecting duct 162*a*, insulation performance of the partition 160*b* can be prevented from being lowered.

The ice-making fan unit 430*b* can be installed in a manner that a rotational axis of the ice-making fan 432*b* is vertical. As a result, the portion projected toward the second storage room 130*b* becomes much smaller, and the inner volume of the second storage room can be greater than in the embodiment shown in FIGS. 10A and 10B.

Figure 12A:
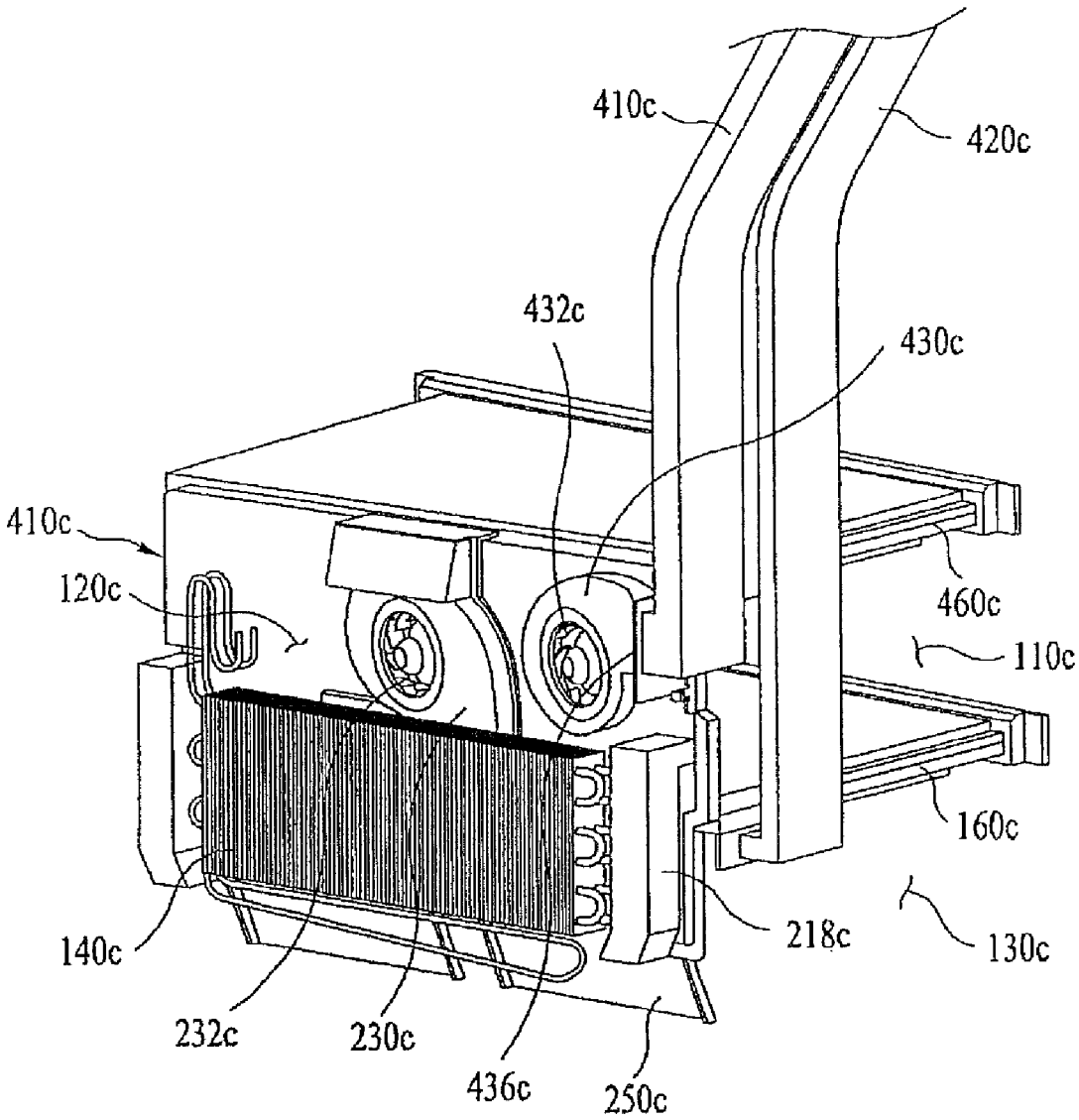
FIG. 12A is a perspective diagram of another embodiment of an icemaker cold-air supplying mechanism viewed from a backside of the food storing apparatus.
Figure 12B:
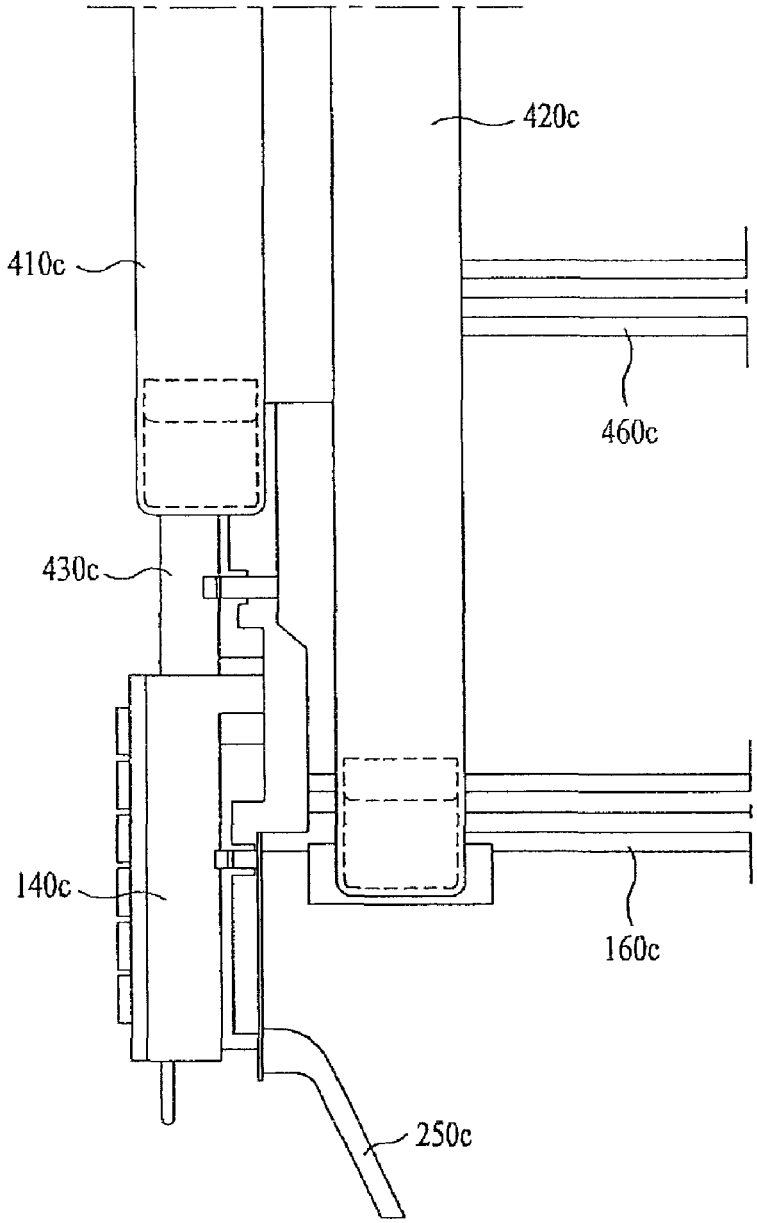
FIG. 12B is a side view of the icemaker cold-air supplying mechanism shown in FIG. 12A.

FIG. 12A is a perspective diagram of another embodiment of an icemaker cold-air supplying mechanism viewed from a backside of a food storing apparatus. FIG. 12B is a side view of the icemaker cold-air supplying mechanism.

Referring to FIG. 12A and FIG. 12B, a rotational shaft of the ice-making fan 432*c* in this embodiment is oriented horizontally. In this case, the ice-making fan unit 430*c* has the same structure as shown in FIG. 11A. The ice-making fan unit 430*c* is provided to one side within the constructing space part 120*c*. A connecting part of the ice-making fan unit 430*c* is connected to a cold air supplying duct 410*c* at a sidewall of the first storage room 110*c*. Here again, a connecting duct inside the partition need not be provided. Thus, insulation performance of the partition 160*c* is not reduced.

Since the ice-making fan unit 430*c* is entirely accommodated within the constructing space part 120*c*, an inner volume of the first storage room 110*c* is not decreased in any way by the fan unit for supplying cold air to the ice maker. Meanwhile, the cold air, which has been supplied to an icemaker (cf. '450*b*' in FIG. 10C) via the ice-making fan unit 430*c* and the cold air supplying duct 410*c*, can be collected by a cold air return duct 420*c*. In this case, the cold air return duct 420*c* is preferably configured to guide the cold air collected from the icemaker to the second storage room 130*c*. Since the first storage room 110*c* is used as a switching room, if the switching room is set to a relatively high temperature such as a cool storage temperature, the first storage room 110*c* avoids being affected by the cold air collected at a relatively low temperature from the icemaker.

Temperature sensors (not shown in the drawings) can be provided within each of the icemaker (cf. '450*b*' in FIG. 10C), the first storage room 110*c* and the second storage room 130*c*. Each of the storage rooms 110*c* and 130*c* has a reference temperature set suitable for a corresponding usage. And, the temperature sensors provided within the storage rooms 110*c* and 130*c* and the icemaker (cf. '450*b*' in FIG. 10) measure inner temperatures thereof, respectively.

A control unit (not shown in the drawings) for controlling overall functions of the food storing apparatus 100 compares the measured storage room temperatures to the reference temperatures of each of the storage rooms. The control unit may also compare the inner temperature of the icemaker to a preset ice-making temperature.

If the storage room temperature is higher than the reference temperature, the control unit activates a blowing fan, which provides cold air to each of the storage rooms. If the storage room temperatures are lower than the reference temperatures, the control unit activates the ice-making fan unit 430*c* to blow the cold air to the icemaker (cf. '450*b*' in FIG. 10C). As noted above, a damper may be provided to a duct for guiding the cold air to the first and/or second storage room 110*c* or 130*c* to turn on/off a passage, or to adjust a quantity of the supplied cold air.

Accordingly, the present invention provides the following effects or advantages.

First of all, since a duct for guiding cold air to different storage rooms directly diverges from a scroll part provided with a blowing fan, a total length of the duct is decreased.

Secondly, since a space occupied by a duct within a food storage apparatus is reduced, a volume of a storage room for keeping food therein can be increased.

Thirdly, since a duct unit including a duct, a damper and a scroll part is built in one body, a manufacturing process can be simplified.

Fourthly, product assembly difficulty is lowered to enhance work productivity.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. More details of the fan are described in U.S. application Ser. No. 12/061,204, whose entire disclosure is incorporated by reference.

Although a number of illustrative embodiments have been described, it should be understood that numerous other modifications and embodiments can be devised by those skilled in the art that will fall within the spirit and scope of the principles of this disclosure. More particularly, variations and modifications are possible in the component parts and/or arrangements of the subject combinations which would fall within the scope of the disclosure, the drawings and the appended claims. In addition to variations and modifications in the component parts and/or arrangements, alternative uses will also be apparent to those skilled in the art.

What is claimed is:

1. A food storage apparatus, comprising:

a first storage room and a second storage room to store food, wherein one of the first and second storage rooms is a freezing chamber, and wherein the other of the first and second storage rooms can be configured to be either a freezing chamber or a refrigerating chamber; and a duct unit including, as a single body:

a first duct to guide cold air into the first storage room;

a second duct to guide cold air into the second storage room;

a scroll-type fan housing from which the first duct and the second duct diverge; and a fan mounted in the scroll-type fan housing that blows cold air radially into the first and second ducts, wherein the fan is a box fan having a motor mounted inside a scroll-type fan blade unit, and wherein the first and second ducts extend away from the fan housing in radial directions of the fan; and a constructing space accommodating a cooling device therein that generates cold air, the constructing space being located behind a rear wall of the first and second storage rooms;

wherein the duct unit is located between the constructing space and the rear of the first and second storage rooms.

2. The food storage apparatus as claimed in claim 1, further comprising a partition that separates the first storage room and the second storage room.

3. The food storage apparatus as claimed in claim 2, wherein the partition is made of an insulating material.

4. The food storage apparatus as claimed in claim 1, wherein the duct unit further comprises at least one first outlet located at an end of the first duct and configured to discharge cold air flowing through the first duct into a first side of the first storage room.

5. The food storage apparatus as claimed in claim 4, wherein the duct unit further comprises at least one first inlet configured to suck cold air from a second side of the first storage room.

6. The food storage apparatus as claimed in claim 5, wherein the first inlet comprises first and second inlets located, respectively, on right and left sides of the first storage room.

7. The food storage apparatus as claimed in claim 5, wherein the duct unit further comprises at least one return duct guiding cold air sucked through the at least one first inlet to the cooling device.

8. The food storage apparatus as claimed in claim 1, wherein the duct unit further comprises at least one second outlet located at an end of the second duct and configured to discharge cold air flowing through the second duct into a first side of the second storage room.

9. The food storage apparatus as claimed in claim 1, wherein the duct unit further comprises a first damper that controls a flow of cold air through the first duct.

10. The food storage apparatus as claimed in claim 9, wherein the first damper is mounted on the first duct.

11. The food storage apparatus as claimed in claim 9, further comprising a second damper that controls a flow of cold air through the second duct.

* * * * *